US008091611B2

(12) United States Patent
Shibata et al.

(10) Patent No.: US 8,091,611 B2
(45) Date of Patent: Jan. 10, 2012

(54) CASTING DIE DEVICE

(75) Inventors: Kiyoshi Shibata, Tokyo (JP); Toshiro Ichihara, Tokyo (JP); Toshiro Hayashi, Tokyo (JP); Keizou Tanoue, Tokyo (JP); Masamitsu Yamashita, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/740,592

(22) PCT Filed: Oct. 23, 2008

(86) PCT No.: PCT/JP2008/003001

§ 371 (c)(1),
(2), (4) Date: Apr. 29, 2010

(87) PCT Pub. No.: WO2009/057263

PCT Pub. Date: May 7, 2009

(65) Prior Publication Data

US 2011/0036529 A1 Feb. 17, 2011

(30) Foreign Application Priority Data

Oct. 30, 2007 (JP) ..... 2007-281096

(51) Int. Cl.
*B22D 17/26* (2006.01)
*B22D 33/04* (2006.01)

(52) U.S. Cl. ..... 164/340; 164/341; 164/342

(58) Field of Classification Search ..... 164/137, 164/339, 340, 341, 342
See application file for complete search history.

(56) References Cited

U.S. PATENT DOCUMENTS

| | | | | |
|---|---|---|---|---|
| 5,111,873 | A * | 5/1992 | Kordovski et al. | 164/312 |
| 5,865,241 | A * | 2/1999 | Bishenden et al. | 164/137 |
| 6,761,208 | B2 * | 7/2004 | Whealy et al. | 164/340 |
| 6,955,210 | B2 * | 10/2005 | Matsuura et al. | 164/339 |

FOREIGN PATENT DOCUMENTS

| | | |
|---|---|---|
| JP | 11-019976 | 1/1999 |
| JP | 2000-033459 | 2/2000 |
| JP | 2003-200248 | 7/2003 |
| JP | 2007-111713 | 5/2007 |

* cited by examiner

*Primary Examiner* — Jessica L Ward
*Assistant Examiner* — Devang R Patel
(74) *Attorney, Agent, or Firm* — Rankin, Hill & Clark LLP

(57) ABSTRACT

A casting die assembly which does not produce any burrs includes a stationary die and a movable die that are clamped in a condition in which a slide core is caused to move toward a center of a movable die, and a back surface of a protrusion of the slide core contacts a stopper section provided on a frame section. The stopper section is subjected to the pressure applied to the slide core during a casting operation. Since the stopper section is provided on part of the frame section, which is integrally formed on the periphery of the stationary die, the stopper section is not caused to retreat or deform by the casting pressure and as a result, the slide core is not moved and burrs are not produced.

7 Claims, 4 Drawing Sheets

CASTING DIE DEVICE

TECHNICAL FIELD

The present invention relates to a casting die assembly in which a movable die is provided with a slide core which forms a product cavity between the movable die and a stationary die.

BACKGROUND ART

Referring to a cylinder head of an engine, a product of complicated shapes including a cooling fin is integrally cast. Accordingly, it is not possible to release a die assembly only with a stationary die and a movable die and the movable die is provided with a plurality of slide cores. The prior art relating to these slide cores is disclosed in Patent Document 1 and the like.

Patent Document 1 discloses a slide die provided to approach and secede from a movable die from four (4) directions and, by holding the cores with these four slide dies, a surface contacting a cylinder block of the cylinder head while molten metal is poured is substantially in a vertical direction.

Patent Document 2 discloses that, in order to prevent the slide core from inclining when dies are clamped, the slide core is provided with a surface adapted to contact the movable die when set in the movable die, part of the slide core is formed to provide a protrusion, and this protrusion is received by the stationary die when the dies are clamped.

Patent reference 1: Japanese Unexamined Patent Publication No. 2000-33459

Patent reference 2: Japanese Unexamined Patent Publication No. 2007-111713

DISCLOSURE OF THE INVENTION

Problem to be Solved by the Invention

FIG. 3 is a figure showing a conventional casting die assembly described above. The casting die assembly comprises a stationary die 101 and a movable die 102. The movable die 102 is provided with a slide core 103 and the like and the stationary die 101 is provided with a stopper section 105 adapted to contact a tapered surface 104*a* of a back surface of a protrusion 104 of the slide core 103 to be subjected to pressure during casting and a positioning section 106 which contacts the side surface 104*b* of the slide core 103. The positioning section 106 is provided with a positioning pin 108 adapted to engage a positioning hole 107 of the movable die.

In the conventional casting die assembly, since the individual stopper section 105 is independently formed in an island shape, the stopper section 105 is deformed under a large casting pressure and as a result, the slide core 103 is returned by the pressure to produce a gap between the slide cores 103 so that molten metal gets into the gap.

Since penetration of the molten metal into the gap not only causes product burrs, but also damages the casting die assembly if left as is, the solidified molten metal must be removed.

Further, a difference in the amount of thermal expansion due to the temperature difference tends to be generated between the slide core and the stationary die. If clamping is conducted in such a condition, the slide core is biased in one direction to cause a gap between the side surfaces of the slide core.

FIG. 4 is a cross-sectional view of the conventional casting die assembly in a clamped condition. In the conventional casting die assembly, the protrusion 104 of the slide core 103 is situated in a position higher than the product cavity.

Accordingly, an effective area (area receiving the casting pressure) of the stopper 105 is relatively small and the metal die is thickened unnecessarily to increase the weight.

Means for Solving the Problem

In order to attain this object, a casting die assembly according to the present invention is provided, in which a movable die is provided with a slide core which forms a product cavity between the movable die and a stationary die, a die matching surface of the stationary die is provided with a frame section which integrally protrudes from the die matching surface, and the internal surface of the frame section is provided with a stopper section adapted to contact the back surface of a protrusion of the slide core during the die clamping operation to be subjected to the casting pressure.

In the present invention, a vertical standard (reference) is set in such a manner that the stationary die is an upper part and the movable die is a lower part. Accordingly, in the actual casting die, even though the stationary die and the movable die are laterally disposed to make the die matching surface perpendicular, the height of the back surface of the movable die is set the bottom surface of height reference.

Further, it is desirable that the four corners of the movable die be provided with positioning reference seats which are as high as the protrusion of the slide core, and a side key be provided between the positioning reference seat and the side surface of the slide core, respectively. It is also desirable that the protrusion of the slide core be substantially on the same level as the product cavity.

EFFECTS OF THE INVENTION

According to the present invention, the die matching surface of the stationary die is provided with the frame section, and the internal surface of the frame section is provided with the stopper section. In the case where the die clamping area becomes too large due to the casting pressure or the thermal expansion and the stopper is worn away, replacement of the stopper only is sufficient.

According to the present invention, the positioning reference seat for the slide core is provided in the movable die, not in the stationary die. In this manner, no gap due to the temperature difference (the difference in the amount of thermal expansion) between the stationary die and the slide core is produced and as a result, burrs are not produced.

Further, according to the present invention, even though the stopper is thinner than before, the effective area (pressure-receiving area) does not change and the entire weight of the casting die assembly can be reduced.

EXPLANATION OF NUMERALS

1 . . . stationary die, 2 . . . movable die, 3 . . . frame section, 4 . . . stopper section, 5 . . . positioning pin, 6 . . . slide core, 7 . . . protrusion, 7*a* . . . back surface off the protrusion, 8 . . .

positioning hole, 9 . . . positioning reference seat, 10 . . . side key, 101 . . . stationary die, 102 . . . movable die, 103 . . . slide core, 104*a* . . . protrusion, 104*b* . . . tapered surface, 105 . . . stopper section, 106 . . . positioning section, 107 . . . positioning hole, 108 . . . positioning pin, C . . . product cavity.

BEST MODE FOR CARRYING OUT THE INVENTION

Figure 1:
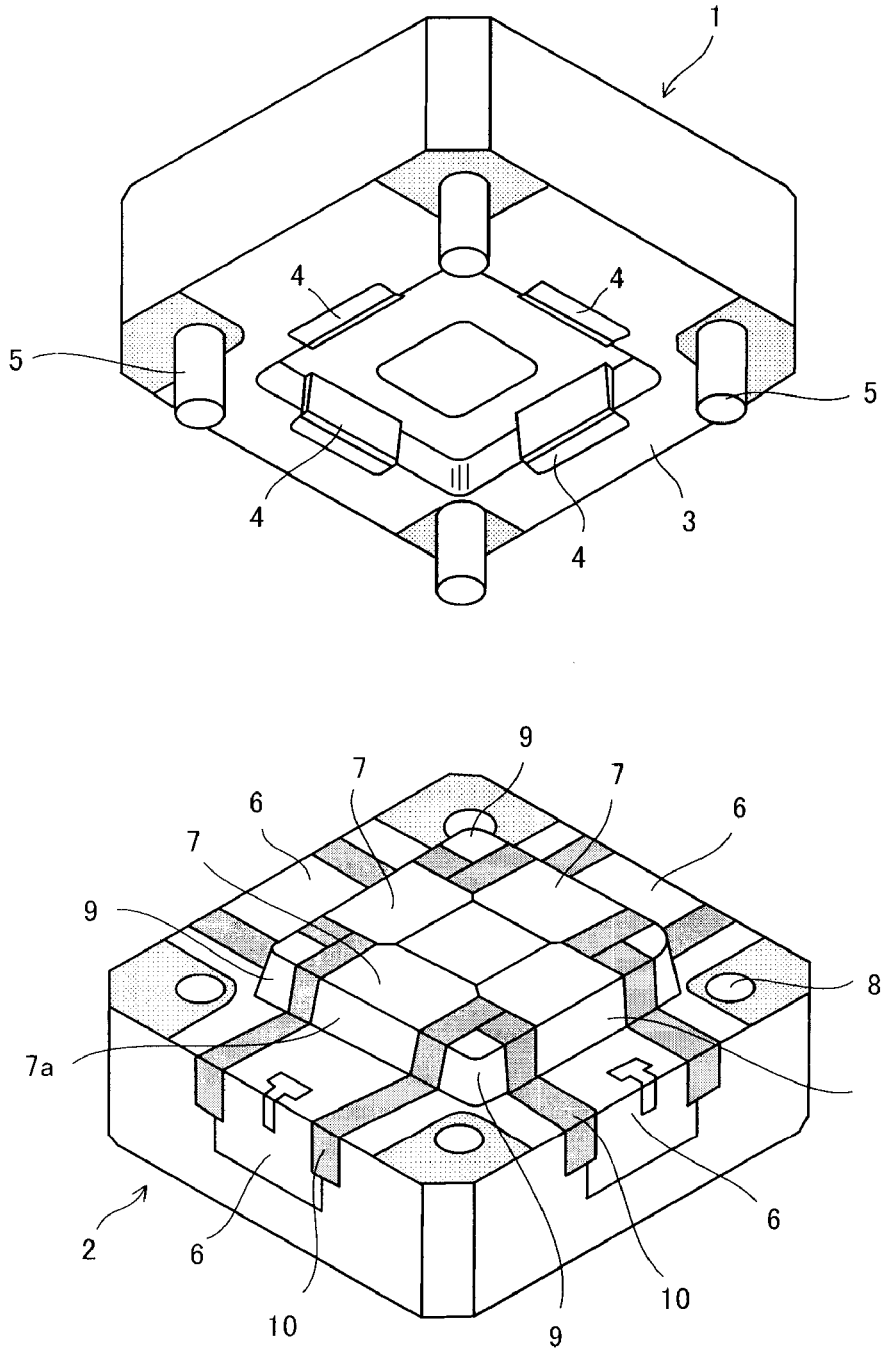
[FIG. 1.] A perspective view of a casting die assembly in an opened condition according to the present invention.

A preferred embodiment of the present invention will now be described with reference to the accompanying drawings. FIG. 1 is a perspective view of a casting die assembly according to the present invention in an opened condition and FIG. 2 is a cross-sectional view of the casting die assembly according to the present invention in a clamped condition.

A casting die assembly comprises a stationary die 1 and a movable die 2. A periphery of a die matching surface of the stationary die 1 is formed as an integrally continued frame section 3. Four stopper sections 4 are provided on the inner peripheral surface of the frame section 3. A back surface of a slide core is adapted to contact the stopper section 4. A positioning pin 5 is attached to four corners of the frame section 3.

A slide core 6 engages the movable die 2. There are four slide cores 6, each being provided with a protrusion 7. By moving each slide core 6 toward the center of the movable die 2, a product cavity C is formed among the stationary die 1, the movable die 2 and the slide core 6. In this condition, the back surface 7*a* (taper surface) of the protrusion 7 contacts the stopper section 4 of the stationary die 1.

Figure 2:
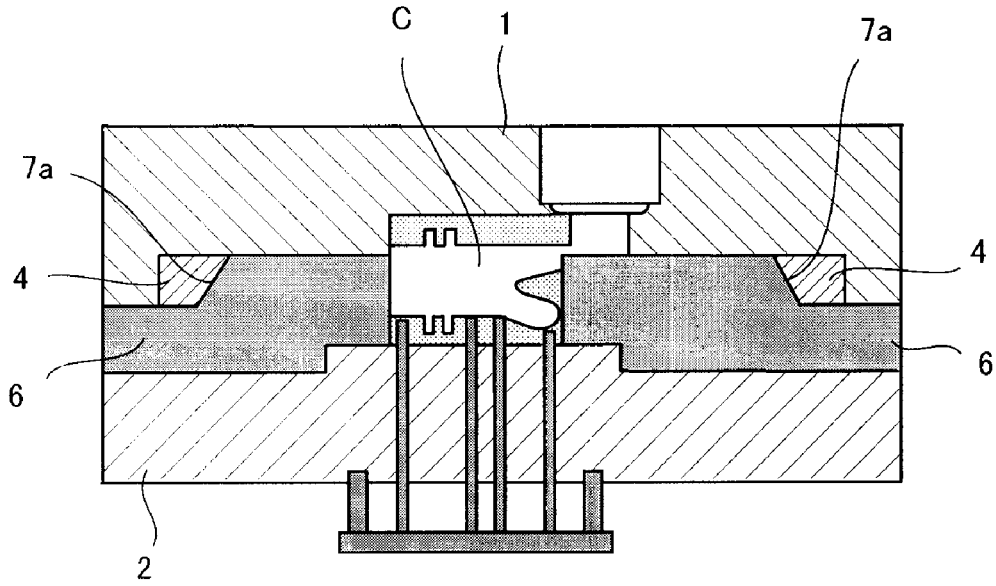
[FIG. 2.] A cross-sectional view of the casting die assembly in a clamped condition.
Figure 3:
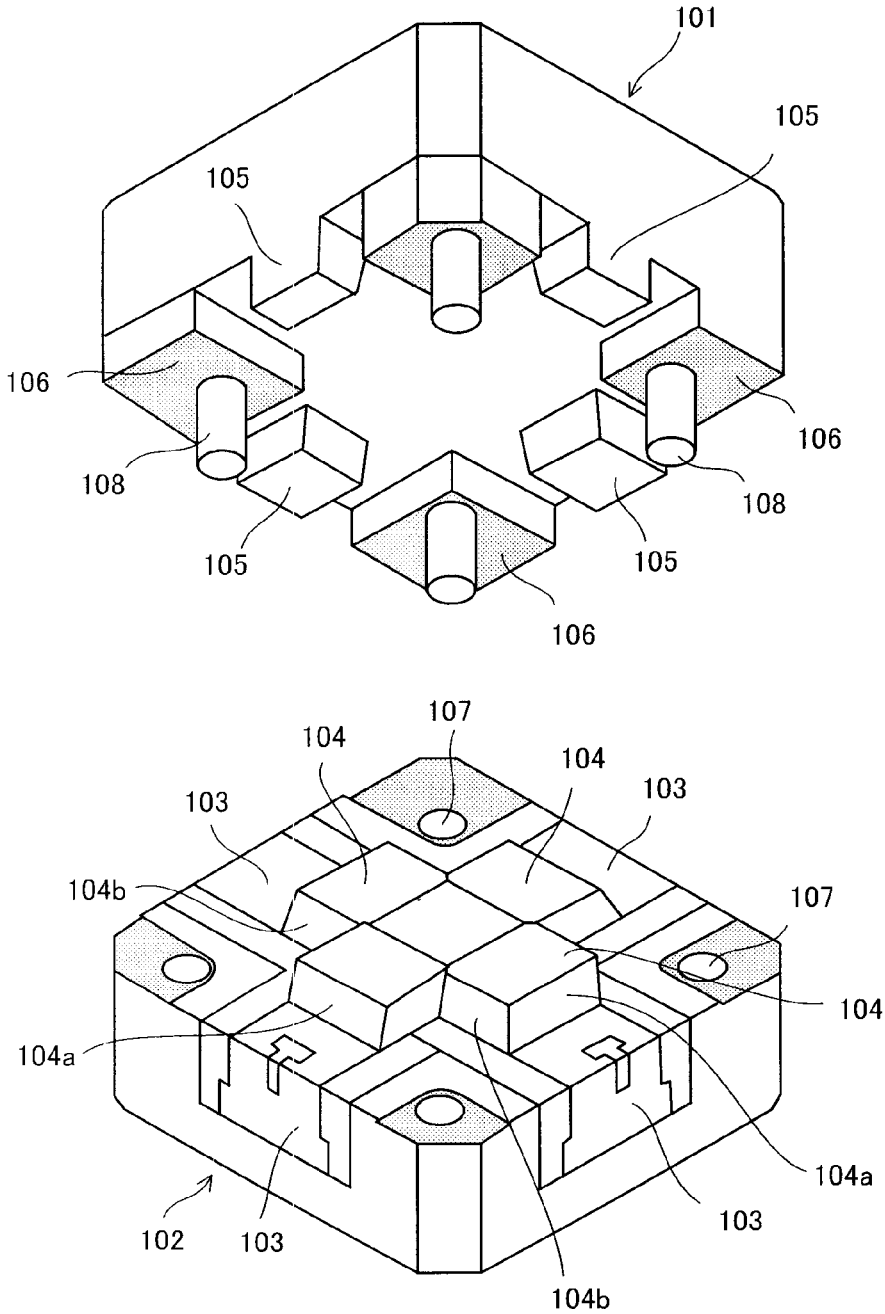
FIG. 3 Prior Art
[FIG. 3.] A perspective view of a conventional casting die assembly in an opened condition.
Figure 4:
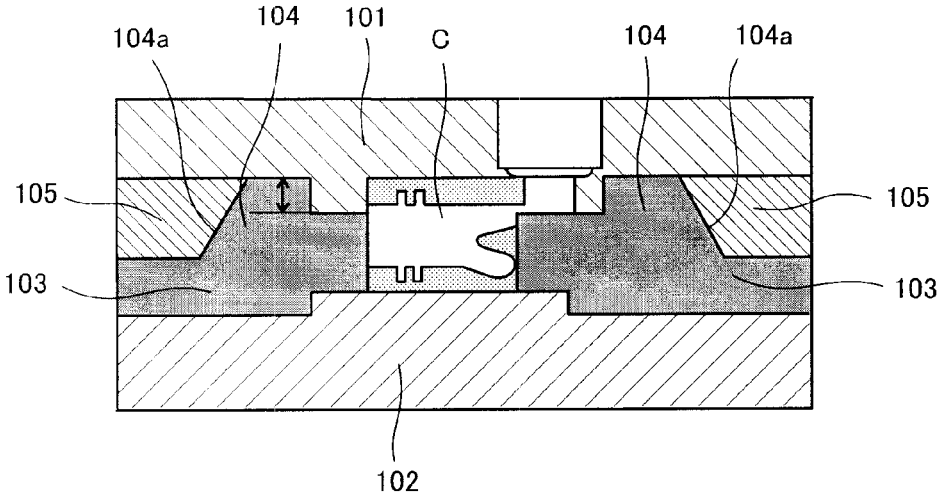
FIG. 4 Prior Art
[FIG. 4.] A cross-sectional view of the conventional casting die assembly in a clamped condition.

As shown in FIG. 2, the protrusion 7 of the slide core 6 situated substantially on the same level as the product cavity C and the whole surface of the stopper section 4 provided on the frame section 3 is subjected to the casting pressure applied on the slide core 6 during casting.

The four corners of the movable die 2 are provided with positioning pins 8 with which the positioning pins 5 engage. Positioning reference seats 9 are provided in a location nearer the center than the positioning holes 8. The positioning reference seats 9 are integrally formed with the movable die 2 and are on the same level as the protrusion 7 of the slide core.

Further, a gap of a slit shape is formed between the slide core 6 and the positioning reference seat 9. Inserted in the gap is a side key 10 which serves as a guide and positioning device when the slide core 6 slides.

In a condition in which four slide cores 6 are caused to move toward the center, when the stationary die 1 and the movable die 2 are clamped, the back surface of the protrusion 7 of the slide core 6 contacts the stopper section 4 provided on the frame section 3, wherein the stopper section 4 comes under pressure applied to the slide core 6 during the casting operation. Since the stopper section 4 is provided on the part of the frame section 3 integrally formed on the periphery of the stationary die 1, the stopper section 4 is not pulled back and deformed and as a result, the slide core 6 is not moved and burrs are not produced.

Further, since the reference seat 9 positioning the slide core 6 is part of the movable die 2, the temperature difference caused between the slide core 6 and the reference seat 9 can be ignored and no gap is produced by the difference in a thermal expansion coefficient between the stationary die 1 and the slide core 6.

The invention claimed is:

1. A casting die assembly, comprising:

a stationary die including a die matching surface and an integral frame section protruding therefrom, the frame section including a stopper section;

a movable die including a slide core with a protrusion having a back surface, the slide core forming a product cavity between the stationary die and the movable die, the movable die further including four corners with each of the four corners having a positioning reference seat, wherein the stopper section contacts the back surface of the protrusion during a die clamping operation and the respective positioning reference seats are on a same level as the protrusion of the slide core when the stopper section contacts the back surface of the protrusion; and a side key disposed between the positioning reference seat and a side surface of the slide core.

2. The casting die assembly according to claim 1, wherein the protrusion of the slide core is situated substantially on a same level as the product cavity.

3. The casting die assembly according to claim 1, wherein the die matching surface, the stopper section, and the internal surface define a void that receives the protrusion of the slide core.

4. A casting die assembly, comprising:

a stationary die including a die matching surface and an integral frame section, the frame section including an internal surface with a stopper section;

a movable die including a plurality of slide cores and each of the slide cores having a protrusion with a back surface, the slide cores forming a product cavity between the stationary die and the movable die, the movable die further including a plurality of positioning reference seats on a same level as the protrusion of the slide core, wherein the stopper section is adapted to contact the back surface of the protrusion during a die clamping operation to be subjected to casting pressure; and a plurality of side keys disposed between the respective positioning reference seats and the slide cores so as to separate the positioning reference seats into four separate corners.

5. The casting die assembly according to claim 4, the stationary die further including an external surface facing in a direction opposite of the die matching surface.

6. The casting assembly according to claim 4, wherein the protrusions of the respective slide cores are situated substantially on a same level as the product cavity.

7. The casting die assembly according to claim 4, wherein the die matching surface, the stopper section, and the internal surface define a void that receives the protrusions of the slide cores.

* * * * *